US006666802B1

(12) United States Patent
Rasmussen

(10) Patent No.: US 6,666,802 B1
(45) Date of Patent: Dec. 23, 2003

(54) ROTARY TILT EXERCISE MACHINE

(76) Inventor: Aaron P. Rasmussen, 1776 Essex St., El Cajon, CA (US) 92020

( * ) Notice: Subject to any disclaimer, the term of this patent is extended or adjusted under 35 U.S.C. 154(b) by 0 days.

(21) Appl. No.: 10/291,994

(22) Filed: Nov. 13, 2002

(51) Int. Cl.[7] ..... A63B 71/00
(52) U.S. Cl. ..... 482/148; 482/140; 482/23
(58) Field of Search ..... 482/148, 140, 482/23, 25, 43, 62, 69, 93, 94, 95, 121–130

(56) References Cited

U.S. PATENT DOCUMENTS 3,612,520 A * 10/1971 Chang ..... 272/57 B

* cited by examiner

*Primary Examiner*—Nicholas D. Lucchesi
*Assistant Examiner*—L Amerson
(74) *Attorney, Agent, or Firm*—Charles C. Logan, II

(57) ABSTRACT

The rotary tilt exercise machine is a gravity-controlled device wherein the user, cradled in a body support unit, employs bodily balance and thrust to roll the body support unit, which is tiltably mounted on the ball joint of a housing drum. A pendular shaft is fixed to the base of the body support unit so that body support unit tilt produces angular displacement of the shaft within the housing. At its extension, the pendular shaft is weighted to provide ballast and centrifugal impetus to body support unit roll. Body support unit motion parameters are defined by either of two optional control devices, specified as a rotary wheel motion controller and as a crank arm motion controller. Auxiliary equipment includes a seat belt and grab bars mounted on the body support unit that stabilize the torso and enable body balance movements that work the back and abdominal muscles.

17 Claims, 4 Drawing Sheets

ROTARY TILT EXERCISE MACHINE

BACKGROUND OF THE INVENTION

The invention relates to exercise apparatus and more specifically to a rotary tilt exercise machine.

Observation of children's playground equipment reveals the popularity of exercise apparatus wherein the user employs bodily motion or thrust to overcome inertia and spring resistance in exchange for a fun ride and some exercise. In these simple devices, thrust force is eventually overcome by a large grounded coil spring, which returns the support assembly to its point of origin.

The value of tilt type exercise equipment resides in its ability to produce body balance movements that energize torso and limb musculature. That fact, coupled with the obvious "fun" appeal of balance oriented exercise equipment has contributed to the growing popularity and commercialization of exercise balls, wobble boards, and rocking blocks that serve as an exhilarate for exercise.

A search of patents and exercise machines revealed that several tilt control devices were developed for stools and chairs with a view to improving their ergonomic and therapeutic characteristics. Abdominal exercise devices were included in the field of inquiry, but they did not contribute in a significant manner to the objectives of the present invention.

Prior art related to applicant's submission is found in a Rocking Stool designated as Federal Republic of Germany Utility Model No. 75 31 129, October 1975. That art specifies a plate base, a saddle, and an intermediate elongated assembly featuring ball joint suspension, with a gas pressure spring serving the resistance and return function. It was designed to provide factory workers with ergonomic comfort at standing workstations.

A second piece of more recent related art was contributed by Josef Glockl, U.S. Pat. No. 5,921,628, Jul. 13, 1999, entitled Pendulating Stool. The Glockl stool's most notable features include a rubber/metal swing connector located at the base, with an intermediate central pillar enclosed by a spring tensioning assembly. This model has a complicated system of bearing elements and mountings that would surely result in high manufacturing costs.

The above cited art pieces were selected because their operative mechanisms were designed to tiltably support a suspended mass, to resist angular displacement, and to provide forcible return of the suspended mass to its point of origin.

SUMMARY OF THE INVENTION

The disclosed exercise machine derives motion when a user, cradled in a body support unit, uses body balance movements to rotate the body support unit on a ball pivotally mounted within bearing blocks of a drum housing. Suspended from the ball, is a weighted pendular shaft that acts as a ballast against housing tip, but which also provides a centrifugal assist to smooth rotary body support unit travel. During exercise, the body support unit acts as a first class lever, tilting on the ball to permit angular displacement of the pendular shaft in a universe of directions. The present invention differs from prior art in that pendular displacement and body support unit tilt is constant, controlled with either of two motion control devices entitled the rotary wheel motion controller and the crank arm motion controller. User movements designed to achieve body support unit roll are shown in FIGS. 5A, 5B, and 6. The resulting rotary tilt ride provides an exhilarating ride while it conditions the abdominal and back muscles. Some specific objectives of the invention follow.

One object of the invention was to produce an exercise machine that could support a user and that would be mechanically reactive to bodily motion and thrust forces that affect the gravitational balance of the machine.

Another object of the invention was to supply a body support unit for postural support of a user's torso.

Another object of the invention was to provide the body support unit with user grab bars to assist in balance control.

Another object of the invention was to supply a seat belt to stabilize the user's waistband and to insure user safety.

Another object of the invention was to provide a centrally located bracket to support a ball stem, and a ball on the underside of the body support unit.

Another object of the invention was to attach a pendular shaft to the ball at a point directly opposite the stem.

Another object of the invention was to provide a housing drum with an open bottom and enclosed top.

Another object of the invention was to provide the housing drum with bearing blocks to provide flexible containment of the ball, and support for the body support unit and pendular shaft.

Another object of the invention was to, provide the protruding end of the pendular shaft with threads to receive a sleeve and threaded weight plates.

Another object of the invention was to provide a manufacture's option in motion control devices, identified as a rotary wheel motion controller and as a crank arm motion controller, each distinctive in structure but consistent in objective.

A final object of the invention was to produce a tiltable body support unit that could enable an exercise client to employ bodily movements, balance, and thrust force to produce a controlled roll of the body support unit in what might be described as a peripheral wobble or waffling motion of the body support unit.

PREFERRED EMBODIMENT OF THE INVENTION

Figure 2:
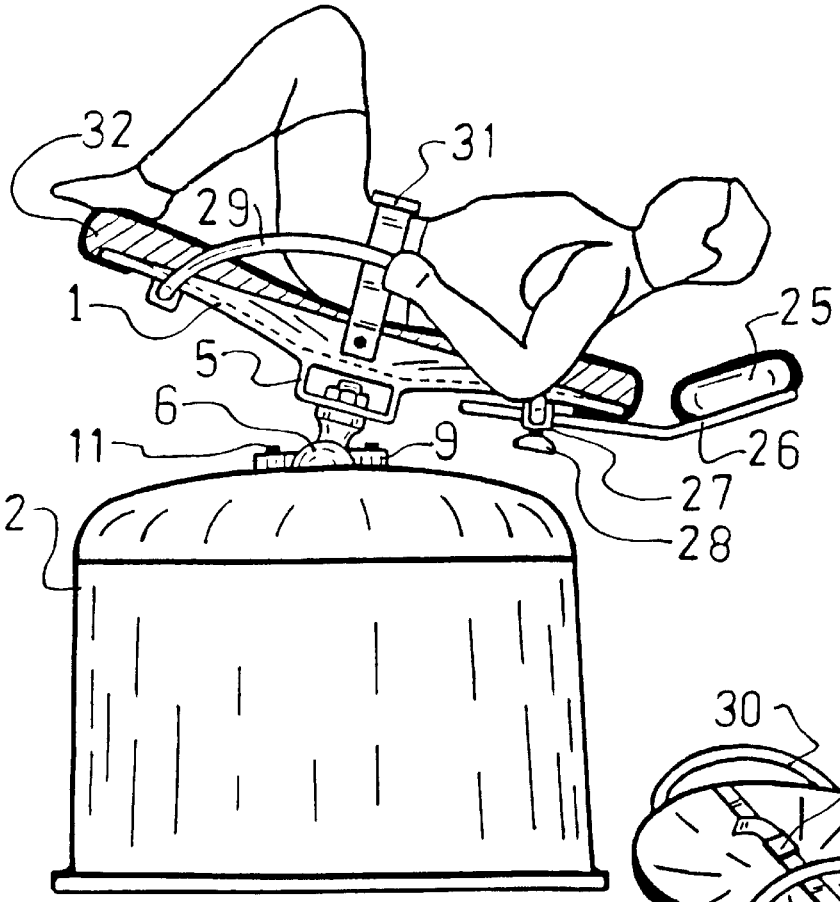
FIG. 2 is an orthographic side view drawing of the housing drum and body support unit, with the user in a reclining postural position and the body support unit in a rearward tilt attitude.
Figure 1:
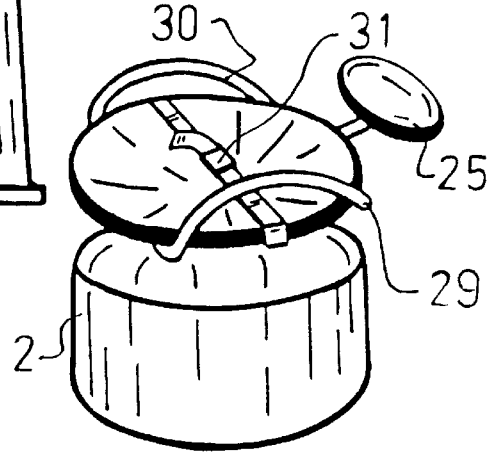
FIG. 1 is a perspective drawing of the rebound exercise machine, illustrating the configuration and relationship of visible machine components.
Figure 3:
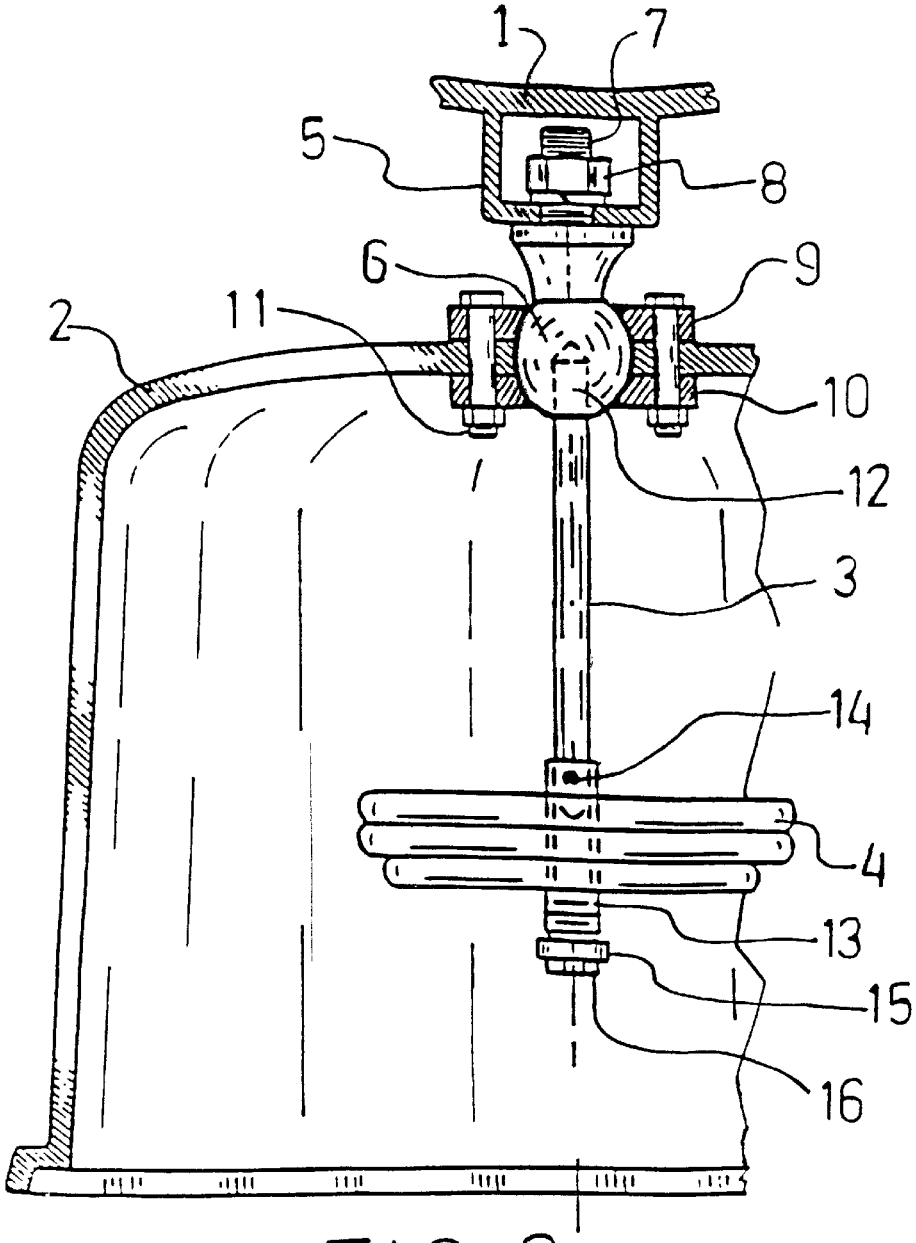
FIG. 3 features a partial, cut-away drawing of the interior of the housing drum, the pendular mechanism, and the sectioned ball joint as described in the Preferred Embodiment Section.

The rotary tilt exercise machine as shown in the pictorial of FIG. 1, acquaints the viewer with the configuration and relationship of machine components. FIG. 2 illustrates the externally visible machine in an orthographic view with a user, cradled in a body support unit 1, that is flexibly supported on a ball joint of a housing drum 2. The body support unit is tilted rearward, as shown in FIG. 2, when the user combines a leg lift maneuver with body thrust. A pendular shaft 3, that suspends weight plates 4, is shown in FIG. 3. That drawing figure also provides a sectioned view of the interior of the housing drum 2 that supports the body support unit. It illustrates a broken out, central section of the body support unit 1, joined to bracket 5, which is mechanically fitted to receive a ball stem 7, with lock nut 8, to fixedly support ball 6. The ball, in turn, resides within bearing blocks 9 and 10, clamped at either side of housing drum 2, with multiple machine screws 11.

The pendular shaft 3 is press fit within a bore 12, of ball 6, at a point directly opposite the ball stem. It may be observed that the pendular shaft 3 is the extension of a class one lever, in which tilt of the body support unit 1, represents applied force. Although the ball joint provides a fulcrum for a universe of body support unit angles, when body support unit roll occurs, the pendular shaft 3 travels in a controlled radial pattern in which angular displacement is constant. At its extension, the shaft 3 is fitted with a threaded sleeve 13, fixed to the shaft with roll pin 14. Sleeve 13 carries weight plates 4, retained at the end by washer 15 and shoulder bolt 16.

Figure 4B:
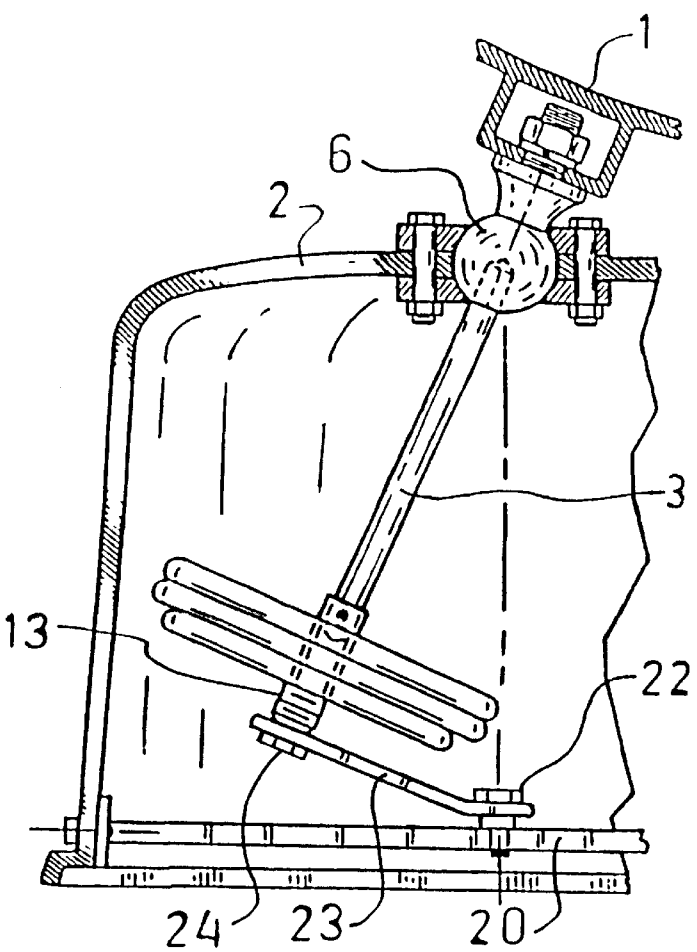
FIG. 4B depicts angular displacement of a pendular shaft and sleeve pivotally joined to an anchor beam with a crank arm, illustrative of the crank arm motion control device.
Figure 4A:
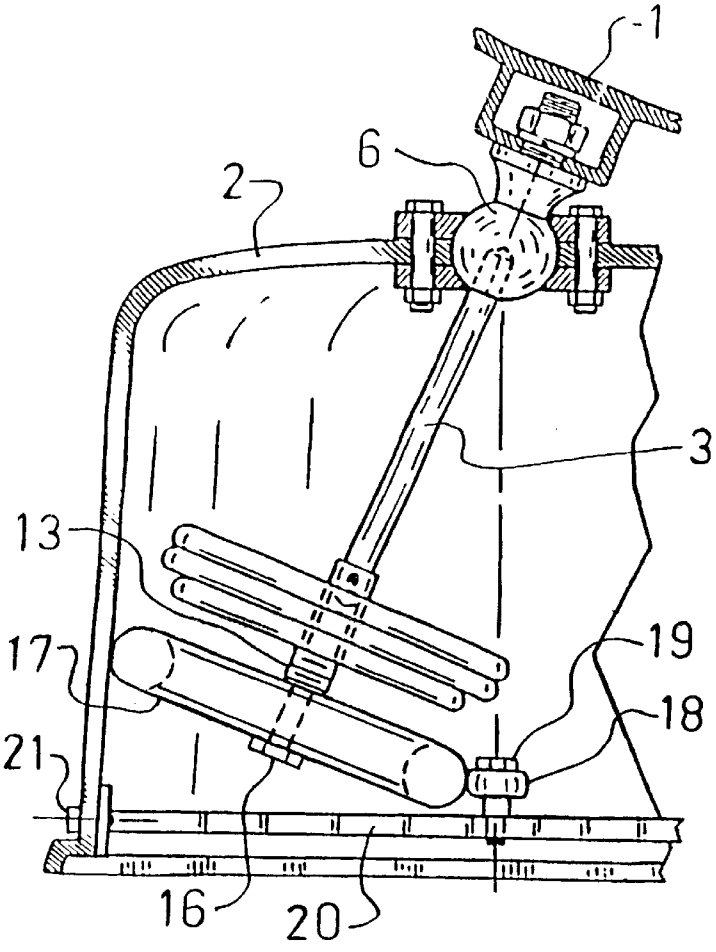
FIG. 4A depicts angular displacement of a pendular shaft and sleeve supporting a wheel that is in running radial contact with a housing drum interior wall and with a bearing rotatably mounted on a housing anchor beam, illustrative of the rotary wheel motion control device.

FIG. 3 displays the components required to permit body support unit tilt absent motion control. The desired motion can best be described as a wobble or waffling motion similar to that experienced when a coin, saucer, or disc-like form is dropped in such a manner as to cause it to roll on its peripheral edge until gravity prevails. FIGS. 4A and 4B provide alternate control devices, each competent to satisfy the motion objective.

Shown in FIG. 4A is the optional rotary wheel motion controller, which includes a wheel and tire 17, which may be of a solid or inflatable type. The wheel is rotatably mounted at the end of pendular sleeve 13, with shoulder bolt 16. The wheel 17 is in running contact with the interior wall of the housing drum 2, to limit outward angular displacement of the pendular shaft 3. At its opposite side, wheel 17 is in rolling contact with a ball bearing 18 to limit inward angular displacement of the shaft. Bearing 18 is centrally mounted on shoulder bolt 19 of anchor beam 20, which is supported at each end with beam bolts 21, joined to the bottom end of housing drum 2.

The alternate motion control option is shown in FIG. 4B, entitled a crank arm motion controller. This device also requires the anchor beam 20. Pivotally attached, with shoulder bolt 22 at the center point of that beam, is one end of crank arm 23. The crank arm extends to the pendular sleeve 13, where it is pivotally joined to the sleeve with shoulder bolt 24. Thus, the crank arm motion controller serves as a rotational connecting rod, routing the pendular shaft 3 in a fixed radius about the shoulder bolt 22 of the anchor beam 20. The operational characteristics of the two controllers indicated, under test, that each could provide a smooth turning movement subsequent to a brief learning curve on the part of the user to develop technique and balancing acumen. The crank arm motion controller does not require a drum housing as does the rotary wheel motion controller and may be less expensive to manufacture, but no cost analysis has been undertaken.

FIGS. 1 and 2 indicate that the body support unit has structure that includes a backrest 25, suspended on a bar 26, that is telescopically adjusted to length within a fitting 27, with a hand screw 28. Also included in support and safety management was a pair of grab bars 29 and 30, and a seatbelt 31. Also, the body support unit 1 has a pad 32 for user comfort.

Figure 5B:
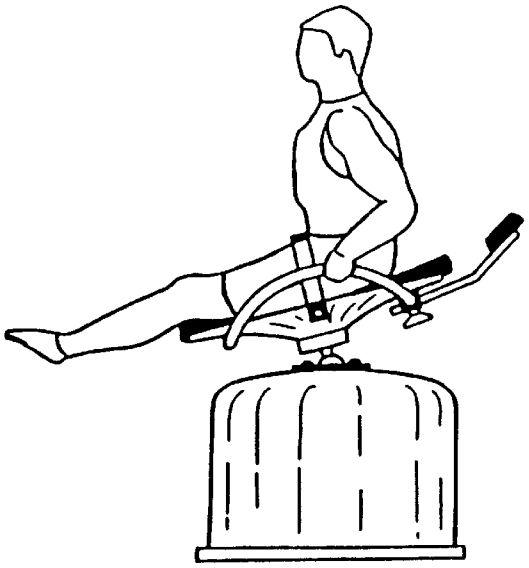
FIGS. 5A and 5B Illustrate a sequential alteration in the body support unit attitude that is responsive to changes in user posture, rolling from a rearward-tilt attitude in FIG. 5A to a forward-tilt attitude in FIG. 5B.
Figure 6:
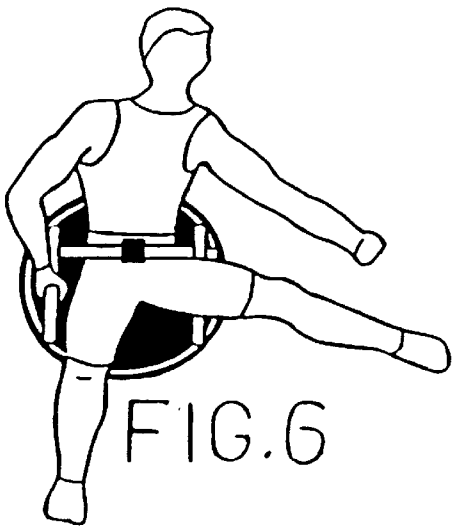
FIG. 6 illustrates, with a top view, arm and leg movements useful, in concert with other body balance moves, to produce lateral body support unit roll.
Figure 5A:
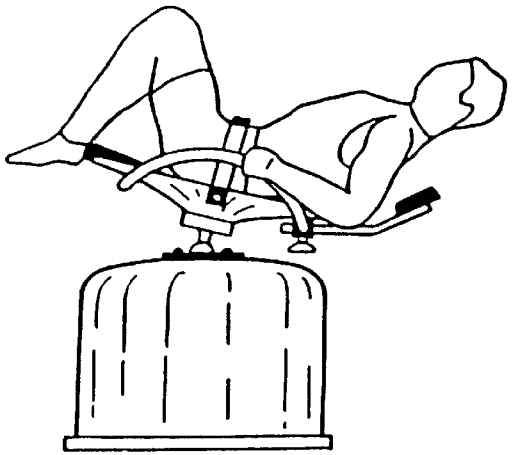

FIGS. 5A, 5B, and 6 are presented to illustrate bodily motion designed to produce body support unit tilt and roll. Exercise is implicit when a user strains to produce equilibrium in body support unit movements. For example, the user in FIG. 5A combines leg extension with a sit-up thrust to arrive at the postural position shown in FIG. 5B. Similarly, when a bias lateral tilt of the body support unit is desired, the user employs arm thrust, as illustrated in FIG. 6 to produce body support unit roll.

The sequential body support unit roll pattern is designed to work the muscle groups of the upper body.

What is claimed is:

1. A rotary tilt exercise machine comprising:

a housing drum having a domed top end and an open bottom end;

a body support unit having a top side and a bottom side for supporting a human torso;

flexible coupling means joining said bottom side of said body support unit to said top end of said housing drum;

a pendular shaft having a top end and a bottom end suspended from said flexible coupling means extends within said housing drum; and means for regulating the weightedness of said pendular shaft.

2. The exercise machine of claim 1 further comprising rotary wheel motion controller means having an anchor beam, a wheel, and bearing means to operatively regulate the angular displacement of, and travel pattern of said pendular shaft and attached body support unit.

3. The exercise machine of claim 1, wherein said flexible coupling means comprises a ball joined by a ball stem to said body support unit; said ball tiltably contained within bearing blocks attached to said housing drum.

4. The exercise machine of claim 3, wherein the structure for the suspension of said pendular shaft comprises a press fit assembly of said top end of said pendular shaft in an interference fit with a hole bored in said ball at a location directly opposite said ball stem.

5. The exercise machine of claim 1, wherein said means for regulating pendular shaft weightedness comprises a threaded pendular sleeve fitted on said bottom end of said pendular shaft and locked in place with a roll pin; said pendular sleeve is threaded externally to receive a desired number of weight plates.

6. The exercise machine of claim 2, wherein said anchor beam of said rotary wheel motion controller means is positioned to bisect said bottom end of said housing drum; said anchor beam providing central support for said bearing means; said wheel attached to said bottom end of said pendular sleeve, said wheel having continuous rotational contact with said bearing means on its innermost side, and with the radial wall of said drum housing on its opposite, outermost side.

7. The exercise machine of claim 1, wherein said body support unit has attached grab bars and a seat belt for safe operation of the device.

8. The exercise machine of claim 1, wherein said body support unit has an optional back rest, with an adjustable position clamping assembly.

9. The exercise machine of claim 1, wherein said body support unit has a pad on said top side for user comfort during exercise.

10. A rotary tilt exercise machine comprising:

a housing drum having a domed top end and an open bottom end;

a support unit having a top side and a bottom side for supporting a human torso;

flexible coupling means joining said bottom side of said body support unit to said top end of said housing drum;

a pendular shaft having a top end and a bottom end suspended from said flexible coupling means extends within said housing drum;

means for regulating the weightedness of said pendular shaft; and crank arm motion controller means having an anchor beam, and a crank arm to operatively regulate the angular displacement of, and travel pattern of said pendular shaft and attached body support unit.

11. The exercise machine of claim 10, wherein said flexible coupling means comprises a ball joined by a ball stem to said body support unit; said ball tiltably contained within bearing blocks attached to said housing drum.

12. The exercise machine of 10, wherein the structure for the suspension of said pendular shaft comprises a press fit assembly of said top end of said pendular shaft in an interference fit with a hole bored in said ball at a location directly opposite said ball stem.

13. The exercise machine of claim 10, wherein said means for regulating pendular shaft weightedness comprises a threaded pendular sleeve fitted on said bottom end of said pendular shaft and locked in place with a roll pin; said pendular sleeve is threaded externally to receive a desired number of weight plates.

14. The exercise machine of claim 10, wherein said anchor beam of said crank arm motion controller means is positioned to bisect said bottom end of said housing drum; said anchor beam provides a pivotal central fulcrum support for said crank arm at a first end; said crank extends, in the manner of a connecting rod, to pivotally join said bottom end of said pendular sleeve.

15. The exercise machine of claim 10, wherein said body support unit has attached grab bars and a seat belt for safe operation of the device.

16. The exercise machine of claim 10, wherein said body support unit has an optional back rest with an adjustable position clamping assembly.

17. The exercise machine of claim 10, wherein said body support unit has a pad on said top side for user comfort during exercise.

* * * * *